US009879670B2

(12) United States Patent
Akatsuka et al.

(10) Patent No.: US 9,879,670 B2
(45) Date of Patent: Jan. 30, 2018

(54) VARIABLE DISPLACEMENT VANE PUMP

(71) Applicant: KAYABA INDUSTRY CO., LTD., Tokyo (JP)

(72) Inventors: Koichiro Akatsuka, Gifu (JP); Tomoyuki Fujita, Gifu (JP); Fumiyasu Kato, Aichi (JP)

(73) Assignee: KYB Corporation, Tokyo (JP)

( * ) Notice: Subject to any disclaimer, the term of this patent is extended or adjusted under 35 U.S.C. 154(b) by 216 days.

(21) Appl. No.: 14/766,525

(22) PCT Filed: Feb. 5, 2014

(86) PCT No.: PCT/JP2014/052682
§ 371 (c)(1),
(2) Date: Aug. 7, 2015

(87) PCT Pub. No.: WO2014/129311
PCT Pub. Date: Aug. 28, 2014

(65) Prior Publication Data

US 2016/0010642 A1 Jan. 14, 2016

(30) Foreign Application Priority Data

Feb. 22, 2013 (JP) ..... 2013-033782

(51) Int. Cl.

| | |
|---|---|
| ***F01C 21/18*** | (2006.01) |
| ***F04C 2/344*** | (2006.01) |
| ***F01C 1/344*** | (2006.01) |
| ***F04C 18/344*** | (2006.01) |
| ***F04C 14/22*** | (2006.01) |

(Continued)

(52) U.S. Cl.
CPC ..... *F04C 14/223* (2013.01); *F04C 2/332* (2013.01); *F04C 2/344* (2013.01); *F04C 14/226* (2013.01); *F04C 15/06* (2013.01); *F04C 2250/10* (2013.01)

(58) Field of Classification Search
CPC ..... F04C 14/223; F04C 2/332
USPC ..... 418/26–30, 259, 260, 81, 150, 24, 206.4
See application file for complete search history.

(56) References Cited

U.S. PATENT DOCUMENTS

2008/0219874 A1* 9/2008 Yamamuro ..... F01C 21/0863 418/82
2010/0303660 A1 12/2010 Konishi et al.

FOREIGN PATENT DOCUMENTS

| | | | |
|---|---|---|---|
| JP | 06-241176 | A | 8/1994 |
| JP | 2003-097454 | A | 4/2003 |
| WO | WO 2009-037763 | A1 | 3/2009 |

* cited by examiner

*Primary Examiner* — Mark Laurenzi
*Assistant Examiner* — Deming Wan
(74) *Attorney, Agent, or Firm* — Rabin & Berdo, P.C.

(57) ABSTRACT

A vane pump includes a rotor, vanes, pump chambers, a suction port, and a discharge port. The side member has a first transition section and a second transition section. The first transition section is a section from an end point of the suction port to a start point of the discharge port. The second transition section is a section from an end point of the discharge port to a start point of the suction port. An angle between the start point and the end point of the suction port is set such that a pressurizing timing is offset from a depressurizing timing. The pressurizing timing is a timing at which one pump chamber starts to communicate with the discharge port from the first transition section, and the (Continued)

depressurizing timing is a timing at which another pump chamber starts to communicate with the suction port from the second transition section.

10 Claims, 5 Drawing Sheets

(51) Int. Cl.
*F04C 15/06* (2006.01)
*F04C 2/332* (2006.01)

VARIABLE DISPLACEMENT VANE PUMP

TECHNICAL FIELD

The present invention relates to a variable displacement vane pump used as a fluid pressure source.

BACKGROUND ART

JP2003-97454A discloses a variable displacement vane pump. The variable displacement vane pump includes a rotor that receives vanes, a cam ring that has an inner circumferential cam face with which tip portions of the vanes are brought into sliding contact and that swings about a support pin, and a side plate that is in sliding contact with one end side of the rotor in the axial direction. On the side plate, a suction port for guiding working fluid into pump chambers that are defined by the rotor, the cam ring, and the adjacent vanes and a discharge port for guiding the working fluid discharged from the pump chambers are formed so as to have an arc shape, respectively.

Therefore, a suction section in which the pump chamber communicates with the suction port, a discharge section in which the pump chamber communicates with the discharge port, and transition sections that are positioned between the suction port and the discharge port are formed on the side plate. In these sections, the pump chambers move into the suction section, the transition section, the discharge section, and the transition section in this order by rotation of the rotor.

SUMMARY OF INVENTION

With the above-mentioned conventional technology, as the rotor rotates, a pump chamber positioned in the one transition section and a pump chamber positioned in the other transition section communicate with the discharge port and the suction port at the same time, respectively.

Thereby, the pressure in the one pump chamber is rapidly increased and the pressure in the other pump chamber is rapidly reduced at the same time. Consequently, because a distribution of pressure acting on the inner circumference of the cam ring is varied rapidly, there is a risk that noise is caused by variation in pressure of the working fluid discharged from the discharge port due to vibration of the cam ring about the pin.

An object of the present invention is to provide a variable displacement vane pump that is capable of suppressing occurrence of noise due to pressure variation of working fluid that is discharged from a discharge port.

According to one aspect of the present invention, a variable displacement vane pump used as a fluid pressure source includes a rotor that is configured to rotationally driven by motive power from a motive-power source; a plurality of slits radially formed so as to open to an outer circumference of the rotor; vanes slidably received in the respective slits; a cam ring having an inner circumferential cam face with which tip portions of the vanes are brought into sliding contact, the cam ring being capable of being made eccentric to a center of the rotor; a side member provided so as to be in contact with a side surface of the cam ring; pump chambers defined by the rotor, the cam ring, the side member, and the adjacent vanes; a suction port formed to have an arc shape on the side member in a region in which displacement of the pump chambers are expanded by rotation of the rotor, the suction port being configured to guide working fluid to be sucked into the pump chambers; and a discharge port formed to have an arc shape on the side member in a region in which displacement of the pump chambers are contracted by rotation of the rotor, the discharge port being configured to guide working fluid discharged from the pump chambers. The side member has a first transition section and a second transition section, the first transition section being a section from an end point of the suction port to a start point of the discharge port, the second transition section being a section from an end point of the discharge port to a start point of the suction port. An angle between the start point and the end point of the suction port with respect to the rotor serving as a center is set such that a pressurizing timing is offset from a depressurizing timing, the pressurizing timing being a timing at which one pump chamber starts to communicate with the start point of the discharge port from the first transition section, the depressurizing timing being a timing at which another pump chamber starts to communicates with the start point of the suction port from the second transition section.

DESCRIPTION OF EMBODIMENT

An embodiment of the present invention will be described below with reference to the attached drawings.

Figure 1:
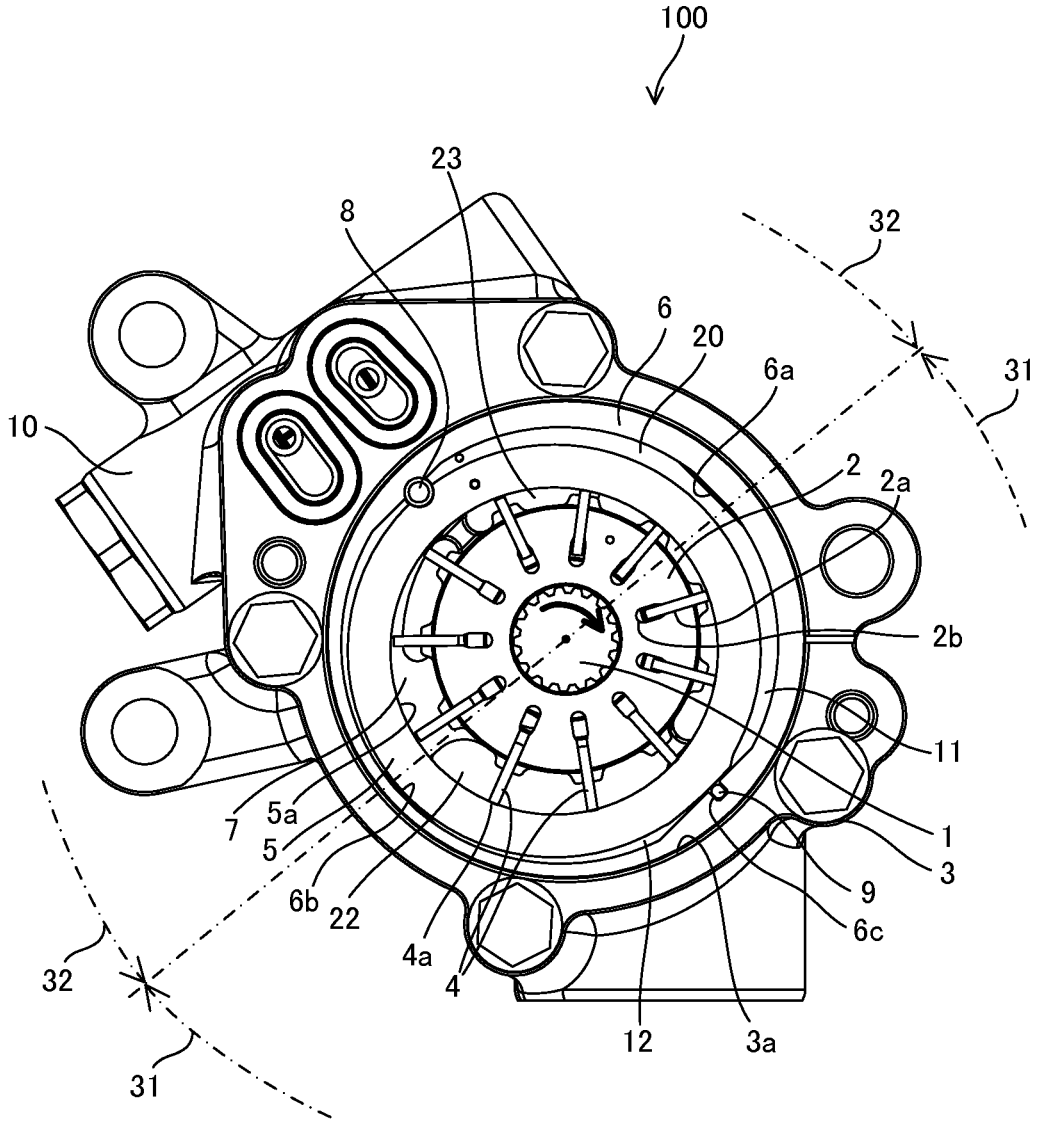
FIG. 1 is a front view showing a variable displacement vane pump according to an embodiment of the present invention.

FIG. 1 is a front view of a variable displacement vane pump 100 (hereinafter, simply referred to as "vane pump 100") according to this embodiment and is a diagram in which the vane pump 100 is viewed from the axial direction of a shaft 1 in a state in which a pump cover has been detached.

The vane pump 100 is used as a fluid pressure source for a fluid hydraulic apparatus, such as, for example, a power steering apparatus, a continuously variable transmission, or the like, mounted on a vehicle. Oil, aqueous alternative fluid of other type, or the like may be used as working fluid.

The vane pump 100 is driven by an engine (not shown) etc., for example, and generates fluid pressure as a rotor 2 linked to the shaft 1 is rotated clockwise as shown by an arrow in FIG. 1.

The vane pump 100 includes a pump body 3, the shaft 1 that is rotatably supported by the pump body 3, the rotor 2 that is linked to the shaft 1 so as to be rotationally driven, a plurality of vanes 4 that are provided so as to be capable of reciprocating in the radial direction relative to the rotor 2, a cam ring 5 that accommodates the rotor 2 and the vanes 4, and an annular adapter ring 6 that surrounds the cam ring 5.

In the rotor 2, a plurality of slits 2*a* having openings on the outer circumferential surface of the rotor 2 are radially formed with predetermined gaps therebetween. The vanes 4 are slidably inserted into the respective slits 2*a*. At the base-end sides of the slits 2*a*, back pressure chambers 2*b* are formed by being defined by base-end portions of the vanes 4. The base end portions are end portions at the opposite side from the direction in which the vanes 4 project from the slits 2*a*. The working fluid is guided to the back pressure chambers 2*b*. The vanes 4 are pushed in the directions projecting out from the slits 2*a* by the pressure of the back pressure chambers 2*b*.

In the pump body 3, a pump accommodating concaved portion 3*a* accommodating the adapter ring 6 is formed. A side plate 20 is arranged on a bottom surface of the pump accommodating concaved portion 3*a* so as to be in contact with the one side in the axial direction (back side in FIG. 1) of each of the rotor 2, the cam ring 5, and the adapter ring 6. An opening of the pump accommodating concaved portion 3*a* is closed with a pump cover (not shown) that is in contact with the other side (front side in FIG. 1) of each of the rotor 2, the cam ring 5, and the adapter ring 6. The pump cover and the side plate 20 serving as side members are arranged in a state in which both side surfaces of each of the rotor 2, the cam ring 5, and the adapter ring 6 are sandwiched. Pump chambers 7 are defined between the rotor 2 and the cam ring 5 by being partitioned by the respective vanes 4.

On the side plate 20, at a sliding contact surface that is in sliding contact with the rotor 2; a through hole 21 into which the shaft 1 is inserted and fitted (see FIG. 3A); a suction port 22 configured to guide the working fluid into the pump chambers 7; and a discharge port 23 configured to discharge the working fluid from the pump chambers 7 to a fluid hydraulic apparatus are formed. The suction port 22 and the discharge port 23 are respectively formed to have an arc shape centered at the through hole 21.

On the pump cover, at the sliding contact surface that is in sliding contact with the rotor 2; a through hole, a suction port, and a discharge port are formed at respective positions symmetrical to those on the side plate 20. In other words, the suction port of the pump cover is in communication with the suction port 22 of the side plate 20 through the pump chambers 7, the discharge port of the pump cover is in communication with the discharge port 23 of the side plate 20 through the pump chambers 7. Furthermore, the through hole of the pump cover is arranged coaxially with the through hole 21 of the side plate 20. If manufacturing precision of the pump cover is low, the individual ports may be set smaller than the respective ports 22 and 23 of the side plate 20 such that switching timing of the ports is determined by the side plate 20.

The cam ring 5 is an annular member, and has an inner circumferential cam face 5*a* with which tip portions 4*a* of the vanes 4, which are end portions of the vanes 4 in the direction projecting from the slits 2*a*, are brought into sliding contact. As the rotor 2 rotates, the tip portions 4*a* of the vanes 4 extend/contract in the radial direction of the rotor 2 while being in sliding contact with the inner circumferential cam face 5*a*. The cam ring 5 defines a suction region 31 and a discharge region 32. The pump chambers 7 are expanded in the suction region 31 and contracted in the discharge region 32 in response to the extension/contraction of the vanes 4.

The suction port 22 penetrates the side plate 20 and communicates with a tank (not shown) through a suction passage (not shown) formed in the pump body 3, and thereby, the working fluid in the tank is passed through the suction passage and is supplied to the pump chambers 7 from the suction port 22 of the side plate 20.

The discharge port 23 penetrates the side plate 20 and communicates with a high-pressure chamber (not shown) formed in the pump body 3. The high-pressure chamber communicates with the fluid hydraulic apparatus (not shown) outside the vane pump 100 through a discharge passage (not shown). In other words, the working fluid discharged from the pump chambers 7 is supplied to the fluid hydraulic apparatus through the discharge port 23, the high-pressure chamber, and the discharge passage.

The adapter ring 6 is accommodated in the pump accommodating concaved portion 3*a* of the pump body 3. A support pin 8 is interposed between the adapter ring 6 and the cam ring 5, closer to the discharge port 23 than the rotor 2. The cam ring 5 is supported by the support pin 8 such that the cam ring 5 swings about the support pin 8 inside the adapter ring 6, and thereby, the cam ring 5 is made eccentric to the center of the shaft 1.

A sealing groove 6*c* is formed on the inner circumference of the adapter ring 6 at a position on the opposite side from the support pin 8 with respect to the center of the shaft 1. A seal member 9 is interposed in the sealing groove 6*c*, and the seal member 9 is brought into sliding contact with the outer circumferential surface of the cam ring 5 when the cam ring 5 swings. A first fluid pressure chamber 11 and a second fluid pressure chamber 12 are partitioned by the support pin 8 and the seal member 9 in a space between the outer circumferential surface of the cam ring 5 and the inner circumferential surface of the adapter ring 6.

The cam ring 5 swings about the support pin 8 by a pressure difference between the first fluid pressure chamber 11 and the second fluid pressure chamber 12. As the cam ring 5 swings, the amount of eccentricity of the cam ring 5 with respect to the rotor 2 is changed, and the discharge capacity of the pump chambers 7 is changed. When the cam ring 5 swings counterclockwise about the support pin 8 in FIG. 1, the amount of eccentricity of the cam ring 5 with respect to the rotor 2 is reduced, and thus, the discharge capacity of the pump chambers 7 is reduced. In contrast, when the cam ring 5 swings clockwise about the support pin 8 in FIG. 1, the amount of eccentricity of the cam ring 5 with respect to the rotor 2 is increased, and thus, the discharge capacity of the pump chambers 7 is increased.

A restricting portion 6*a* that restricts movement of the cam ring 5 in the direction in which the amount of eccentricity with respect to the rotor 2 is reduced and a restricting portion 6*b* that restricts movement of the cam ring 5 in the direction in which the amount of eccentricity with respect to the rotor 2 is increased are respectively formed on the inner circumferential surface of the adapter ring 6 in a swelled manner. In other words, the restricting portion 6*a* defines the minimum amount of eccentricity of the cam ring 5 with respect to the rotor 2, and the restricting portion 6*b* defines the maximum amount of eccentricity of the cam ring 5 with respect to the rotor 2.

The pressure difference between the first fluid pressure chamber 11 and the second fluid pressure chamber 12 is controlled by a control valve 10 that supplies the working fluid pressure to the first fluid pressure chamber 11 and the second fluid pressure chamber 12. The control valve 10 controls the working fluid pressure in the first fluid pressure chamber 11 and the second fluid pressure chamber 12 such that the amount of eccentricity of the cam ring 5 with respect to the rotor 2 is reduced with the increase in the rotation speed of the rotor 2.

Figure 2:
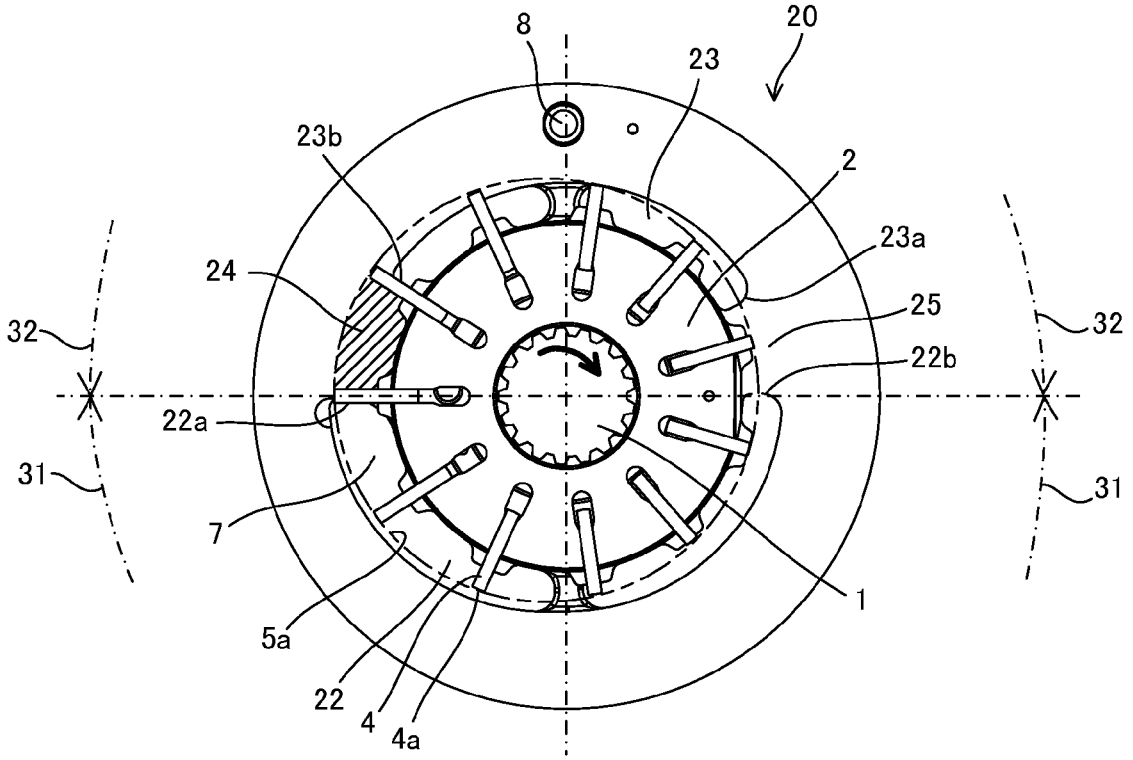
FIG. 2 is a front view showing a state in which a rotor and vanes are arranged on a side plate according to the embodiment of the present invention.

FIG. 2 is a front view in which the rotor 2 and the vanes 4 are arranged on the side plate 20. In FIG. 2, the side plate 20 is shown to be oriented such that the support pin 8 is positioned in the twelve-o'clock direction in the figure. Furthermore, the two-dot broken line in FIG. 2 corresponds to the inner circumferential cam face 5*a* of the cam ring 5 when the amount of eccentricity of the cam ring 5 is the maximum.

The rotor 2, into which the vanes 4 are received, is fitted to the shaft 1 that is fitted to the side plate 20. The vanes 4 projecting in the radial direction from the rotor 2 are brought into sliding contact with the inner circumferential cam face 5*a* of the cam ring 5 at their tip portions 4*a*. The pump chambers 7 that are defined by the rotor 2, the cam ring 5, and the adjacent vanes 4 move in the circumferential direction of the rotor 2 by rotation of the rotor 2, thereby changing their displacement in response to extension/contraction of the vanes 4.

In the suction region 31, the pump chambers 7 are in communication with the suction port 22, and the working fluid is sucked from the suction port 22 to the pump chambers 7. In the discharge region 32, the pump chambers 7 are in communication with the discharge port 23, and the working fluid is discharged from the pump chambers 7 through the discharge port 23. In order to switch between the suction into the pump chambers 7 in the suction region 31 and the discharge from the pump chambers 7 in the discharge region 32, predetermined gaps are provided between the suction port 22 and the discharge port 23.

In other words, a first transition section 24 is provided between from an end point 22*a* of the suction port 22 to a start point 23*b* of the discharge port 23, and a second transition section 25 is provided between from an end point 23*a* of the discharge port 23 to a start point 22*b* of the suction port 22.

A case in which the pump chamber 7 passes through the first transition section 24 by the rotation of the rotor 2 will be described.

As the pump chamber 7 that is in communication with the suction port 22 over the whole region in the circumferential direction approaches the first transition section 24, the opening area to the suction port 22 is gradually reduced, and at the same time, the overlapping area with the first transition section 24 is gradually increased. Thereafter, when a state in which the pump chamber 7 is overlapped with the first transition section 24 over the whole region in the circumferential direction is achieved, as shown with the inclined lines in FIG. 2, the working fluid is trapped in the pump chamber 7. In this case, the pump chamber 7 is not in communication with neither of the suction port 22 nor the discharge port 23 or, even if the pump chamber 7 is in communication with either of them, the opening area is very small.

From the above-described state, as the rotor 2 rotates further, the pump chamber 7 starts to communicate with the start point 23*b* of the discharge port 23. In other words, the front vane 4 of the pump chamber 7 in the circumferential direction crosses over the start point 23*b* of the discharge port 23. At this time, because the high-pressure working fluid in the discharge port 23 flows into the pump chamber 7 forcedly, the pump chamber 7 is pressurized (hereinafter, this timing is referred to as "pressurizing timing").

A case in which the pump chamber 7 passes through the second transition section 25 by the rotation of the rotor 2 will be described.

As the pump chamber 7 that is in communication with the discharge port 23 over the whole region in the circumferential direction approaches the second transition section 25, the opening area to the discharge port 23 is gradually reduced, and at the same time, the overlapping area with the second transition section 25 is gradually increased. Thereafter, when a state in which the pump chamber 7 is overlapped with the second transition section 25 over the whole region in the circumferential direction is achieved, the working fluid is trapped in the pump chamber 7. In this case, the pump chamber 7 is not in communication with neither of the suction port 22 nor the discharge port 23 or, even if the pump chamber 7 is in communication with either of them, the opening area is very small.

From the above-described state, as the rotor 2 rotates further, the pump chamber 7 starts to communicate with the start point 22*b* of the suction port 22. In other words, the front vane 4 of the pump chamber 7 in the circumferential direction crosses over the start point 22*b* of the suction port 22. At this time, because the working fluid in the pump chamber 7 flows out forcedly due to the negative pressure in the suction port 22, the pump chamber 7 is depressurized (hereinafter, this timing is referred to as "depressurizing timing").

Figure 5:
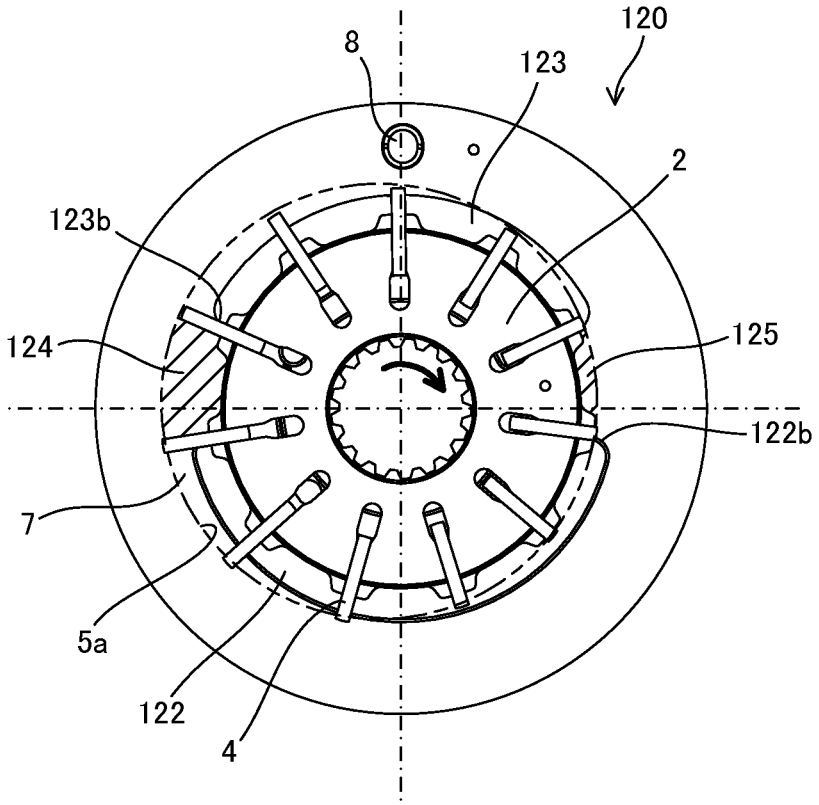
FIG. 5 is a front view showing a state in which a rotor and vanes are arranged on a side plate according to a comparative example.

Here, a pressurizing timing and a depressurizing timing in a vane pump according to a comparative example will be described with reference to FIG. 5. FIG. 5 is a front view showing a state in which the rotor 2 and the vanes 4 are arranged on a side plate 120 according to the comparative example. Similarly to FIG. 2, in FIG. 5, the side plate 120 is shown to be oriented such that the support pin 8 is positioned in the twelve-o'clock direction in the figure. Furthermore, the two-dot broken line in FIG. 5 corresponds to the inner circumferential cam face 5*a* of the cam ring 5 when the amount of eccentricity of the cam ring 5 is the maximum.

In the comparative example, as shown with the inclined lines in FIG. 5, by the rotation of the rotor 2, one of the pump chambers 7 is overlapped with a first transition section 124 over the whole region in the circumferential direction, and at the same time, another pump chamber 7 is overlapped with a second transition section 125 over the whole region in the circumferential direction.

Therefore, as the rotor 2 rotates from the state shown in FIG. 5, the pump chamber 7 at the first transition section 124 side and the pump chamber 7 at the second transition section 125 side respectively communicate with a start point 123*b* of a discharge port 123 and a start point 122*b* of a suction port 122 at the same time. In other words, the pressurizing timing coincides with the depressurizing timing.

If the pump chamber 7 at the first transition section 124 side and the pump chamber 7 at the second transition section 125 side are respectively pressurized and depressurized at the same time, in the distribution of the pressure received on the whole circumference of the inner circumferential cam face 5*a* of the cam ring 5 from all pump chambers 7, the high pressure portion is biased to the first transition section 124 side. Thereby, a force acts on the cam ring 5 in the direction in which the cam ring 5 is swung clockwise in FIG. 5 about the support pin 8.

This bias in the pressure distribution is generated every time the pressurizing timing coincides with the depressurizing timing as the rotor 2 rotates through the operation, thereby causing the cam ring 5 to vibrate at a predetermined period. Therefore, there is a risk that noise is caused due to variation in the pressure of the working fluid discharged from the discharge port 123.

Thus, in this embodiment, as shown in FIG. 2, the suction port 22 is formed such that the pressurizing timing does not coincide with the depressurizing timing. The suction port 22 has an arc shape, and this shape is defined by an angle θ1 between the start point 22*b* and the end point 22*a* of the suction port 22 with respect to the rotor 2 serving as the center (hereinafter referred to as "angle θ1 of the suction port 22").

In the following description, as shown in FIG. 2, although a case in which the amount of eccentricity of the cam ring 5 is the maximum is supposed, the angle θ1 of the suction port 22 is set such that the pressurizing timing does not coincide with the depressurizing timing even when the amount of eccentricity of the cam ring 5 is smaller.

Because the suction region 31 defined by the cam ring 5 is formed over the region of 180° that is half of the inner circumferential cam face 5*a* in the circumferential direction, by setting the angle θ1 of the suction port 22 to about 180°, it is possible to increase a sucking area, thereby improving a sucking property for the working fluid to improve pump performance.

In addition, the discharge port 23 has an arc shape, and this shape is defined in accordance with the angle θ1 of the suction port 22. Between the end point 22*a* of the suction port 22 and the start point 23*b* of the discharge port 23 (in the first transition section 24), a gap corresponding to an approximately one room of the pump chamber is formed. Similarly, a gap corresponding to an approximately one room of the pump chamber is also formed between the end point 23*a* of the discharge port 23 and the start point 22*b* of the suction port 22 (in the second transition section 25).

Therefore, by setting the angle θ1 of the suction port 22 to about 180°, an angle θ2 between from the start point 23*b* to the end point 23*a* of the discharge port 23 (hereinafter referred to as "the angle θ2 of the discharge port 23") is set so as to become smaller than the angle θ1 of the suction port 22 by the angles corresponding to the first transition section 24 and the second transition section 25.

In addition, as described above, the cam ring 5 is made eccentric to the center of the rotor 2 by being swung clockwise about the support pin 8 as shown in FIG. 2. As the amount of eccentricity of the cam ring 5 is increased, because the inner circumferential cam face 5*a* in the second transition section 25 is moved from the outer circumferential side to the inner circumferential side of the discharge port 23 and the suction port 22, the angle range of the second transition section 25 is increased. Therefore, the angle of the second transition section 25 with respect to the rotor 2 serving as the center is set so as to be equal to or less than the angle of the first transition section 24.

The angle range of the suction port 22 will be described below. The angle range of the suction port 22 is different depending on whether the number of the vanes 4 received in the rotor 2 is an odd number or an even number.

Figure 3A:
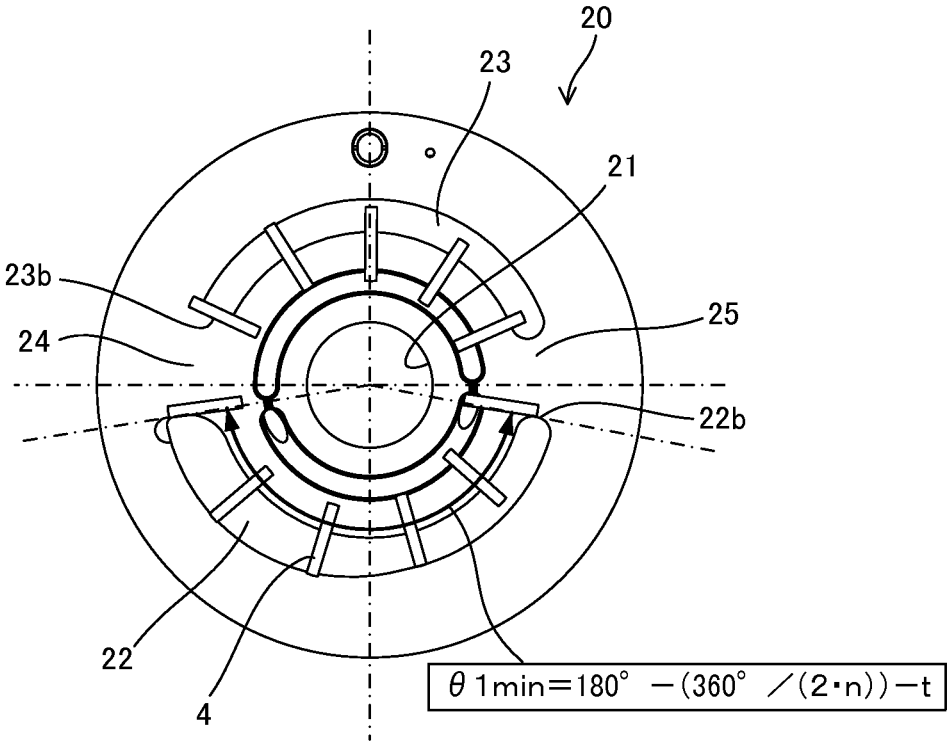
FIG. 3A is a front view showing the side plate when the number of vanes is an odd number.
Figure 3B:
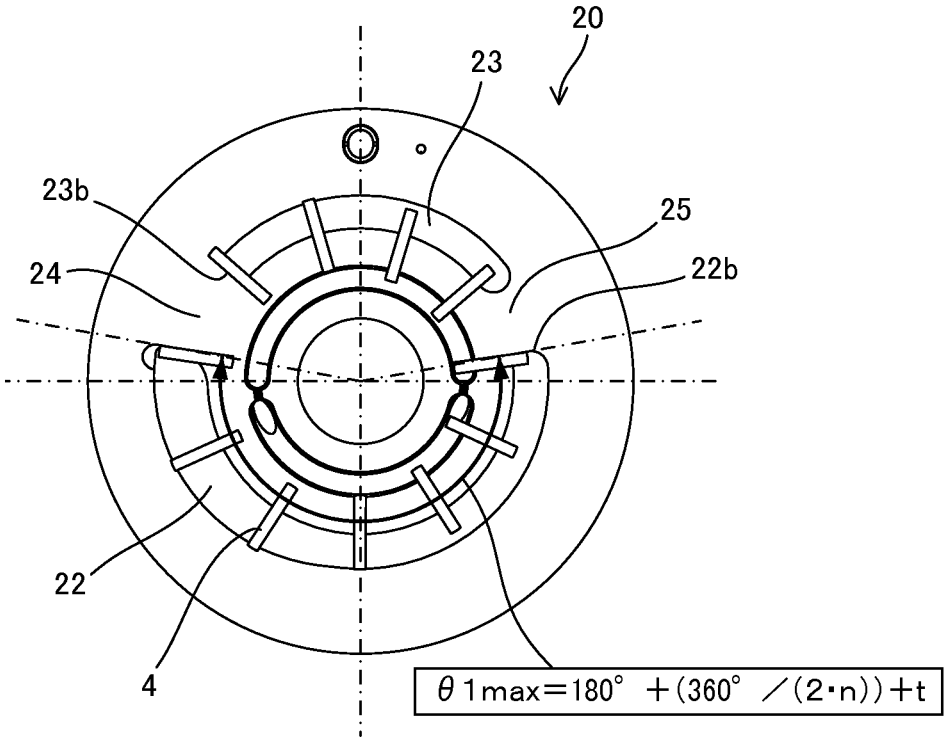
FIG. 3B is a front view showing the side plate when the number of vanes is an odd number.

FIG. 3A is a diagram showing the minimum angle θ1 min of the suction port 22 in a case where the number of the vanes 4 is an odd number. FIG. 3B is a diagram showing the maximum angle θ1 max of the suction port 22 in a case where the number of the vanes 4 is an odd number. Although FIGS. 3A and 3B show a case in which the number of the vanes 4 is eleven as an example, the number of the vanes 4 may be an odd number of five or more including nine or thirteen.

When the number of the vanes 4 is an odd number, a position offset from a certain vane 4 by 180° with respect to the rotor 2 as the center corresponds to the intermediate position between two vanes 4 arranged so as to sandwich the intermediate position at both sides thereof, in other words, corresponds to the intermediate position of the pump chamber 7.

Therefore, when 180° is taken as a reference, the minimum angle θ1 min of the suction port 22 is the value obtained by subtracting the angle corresponding to the half of the pump chamber 7 and the angle corresponding to the thicknesses of the vanes 4 from 180°. Similarly, the maximum angle θ1 max of the suction port 22 is the value obtained by adding the angle corresponding to the half of the pump chamber 7 and the angle corresponding to the thicknesses of the vanes 4 to 180°.

In other words, if the number of the vanes 4 is indicated as n (n=5, 7, 9 . . . ) and the angle corresponding to the thicknesses of the vanes 4 is indicated as t, the angle θ1 of the suction port 22 is set within the range calculated as $180°-(360°/(2\times n))-t\leq 1\leq 180°+(360°/(2\times n))+t$.

Thereby, as shown in FIGS. 3A and 3B, when the pump chamber 7 at the first transition section 24 side starts to communicate with the start point 23*b* of the discharge port 23, the pump chamber 7 at the second transition section 25 side is not in communication with the start point 22*b* of the suction port 22, and thereby, it is possible to offset the pressurizing timing and the depressurizing timing.

Figure 4A:
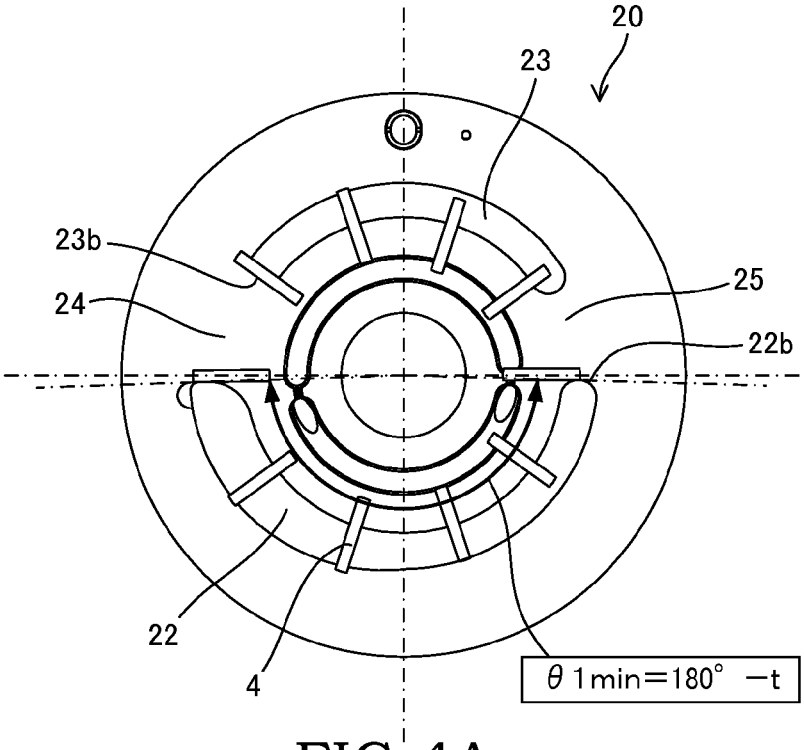
FIG. 4A is a front view showing the side plate when the number of vanes is an even number.
Figure 4B:
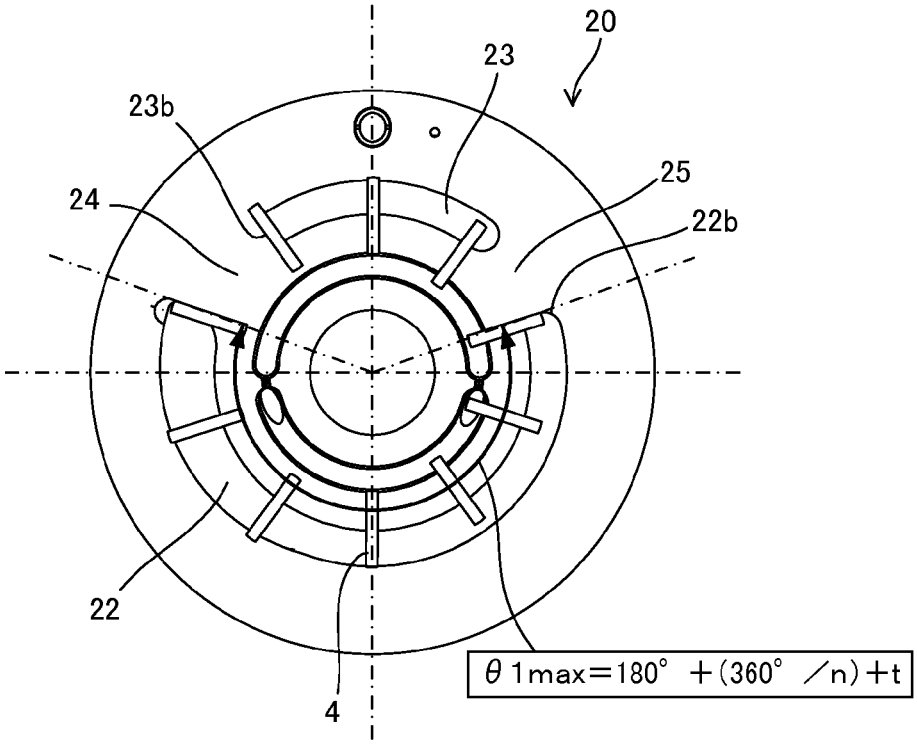
FIG. 4B is a front view showing the side plate when the number of vanes is an even number.

On the other hand, FIG. 4A is a diagram showing the minimum angle θ1 min of the suction port 22 in a case where the number of the vanes 4 is an even number. FIG. 4B is a diagram showing the maximum angle θ1 max of the suction port 22 in a case where the number of the vanes 4 is an even number. Although FIGS. 4A and 4B show a case in which the number of the vanes 4 is ten as an example, the number of the vanes 4 may be an even number of six or more including eight or twelve.

When the number of the vanes 4 is an even number, at a position offset from a certain vane 4 by 180° with respect to the rotor 2 as the center, there is another vane 4.

Therefore, when 180° is taken as a reference, the minimum angle θ1 min of the suction port 22 is the value obtained by subtracting the angle corresponding to the thickness of the vanes 4 from 180°. Similarly, the maximum angle θ1 max of the suction port 22 is the value obtained by adding the angle corresponding to the pump chambers 7 and the angle corresponding to the thickness of the vanes 4 to 180°.

In other words, if the number of the vanes 4 is indicated as n (n=6, 8, 10 . . . ) and the angle corresponding to the thickness of the vanes 4 is indicated as t, the angle θ1 of the suction port 22 is set within the range calculated as $180°-t\leq 180°+(360°/n)+t$.

Thereby, as shown in FIGS. 4A and 4B, when the pump chamber 7 at the first transition section 24 side starts to communicate with the start point 23*b* of the discharge port 23, the pump chamber 7 at the second transition section 25 side is not in communication with the start point 22*b* of the suction port 22, and thereby, it is possible to offset the pressurizing timing and the depressurizing timing.

According to the embodiment mentioned above, the advantages described below are afforded.

The angle θ1 of the suction port 22 is set such that the pressurizing timing in which one of the pump chambers 7 starts to communicate with the start point 23*b* of the discharge port 23 from the first transition section 24 and the depressurizing timing in which another of the pump chambers 7 starts to communicate with the start point 22*b* of the suction port 22 from the second transition section 25 are offset. Thus, it is possible to suppress rapid change of the pressure distribution acting on the inner circumference of the cam ring 5, and so, it is possible to prevent occurrence of noise due to pressure variation of the working fluid discharged from the discharge port 23 caused by vibration of the cam ring 5.

Furthermore, because the angle θ1 of the suction port 22 is set so as to become greater than the angle θ2 of the discharge port 23, it is possible to improve the pump performance by improving the sucking property for the working fluid. In addition, because the angle θ2 of the discharge port 23 is relatively small, and so the area of the discharge port 23 subjected to the pressure from the high-pressure working fluid is small, the force generated within the pump is reduced, and thereby, it is possible to reliably prevent the variation in the pressure of the working fluid due to vibration of the cam ring 5.

Furthermore, when the number n of the vanes 4 is an odd number of five or more, the angle θ1 of the suction port 22 is defined by the equation $180°-(360°/(2\times n))-t\leq\theta1\leq180°+(360°/(2\times n))+t$. Thereby, in the vane pump 100 in which the number of the vanes 4 is an odd number of five or more, it is possible to improve the sucking property by keeping the angle θ1 of the suction port 22 close to 180°, and at the same time, it is possible to avoid the pressurizing timing and the depressurizing timing from coinciding with each other.

Furthermore, when the number n of the vanes 4 is an even number of six or more, the angle θ1 of the suction port 22 is defined by the equation $180°-t\leq\theta1\leq180°+(360°/n)+t$. Thereby, in the vane pump 100 in which the number of the vanes 4 is an even number of six or more, it is possible to improve the sucking property by keeping the angle θ1 of the suction port 22 close to 180°, and at the same time, it is possible to avoid the pressurizing timing and the depressurizing timing from coinciding with each other.

Furthermore, because the angle of the second transition section 25 with respect to the rotor 2 serving as the center is set so as to become smaller than the angle of the first transition section 24, it is possible to prevent the increase in the difference between the angle range of the first transition section 24 and that of the second transition section 25 that is caused by the increase in the angle range of the second transition section 25 due to the increase in the amount of eccentricity of the cam ring 5 and the movement of the inner circumferential cam face 5*a* from the outer circumferential side to the inner circumferential side of the discharge port 23 and the suction port 22.

Furthermore, because the angle θ1 of the suction port 22 is set such that the pressurizing timing does not coincide with the depressurizing timing all the time regardless of the amount of eccentricity of the cam ring 5, it is always possible to prevent the variation in the pressure of the working fluid due to vibration of the cam ring 5 regardless of the rotation speed of the vane pump 100.

Furthermore, because the vane pump 100 includes the first fluid pressure chamber 11 and the second fluid pressure chamber 12 that make the cam ring 5 eccentric to the rotor 2 by the pressure difference between the first fluid pressure chamber 11 and the second fluid pressure chamber 12, and the control valve 10 that controls the pressure of the working fluid in the first fluid pressure chamber 11 and the second fluid pressure chamber 12, the variation in the pressure of the working fluid discharged from the discharge port 23 is suppressed, and in turn, the variation in the pressure of the working fluid guided from the discharge port 23 to the first fluid pressure chamber 11 and the second fluid pressure chamber 12 is also suppressed. Therefore, it is possible to make the control valve 10 function suitably.

Embodiments of this invention were described above, but the above embodiments are merely examples of applications of this invention, and the technical scope of this invention is not limited to the specific constitutions of the above embodiments.

For example, in the above-mentioned embodiment, although the angles θ1 and θ2 of the suction port 22 and the discharge port 23 to be provided on the side plate 20 are defined, angles of the suction port and the discharge port to be provided on the pump cover may also be defined in the similar manner.

Furthermore, in the above-mentioned embodiment, the case in which the angle θ1 of the suction port 22 is greater than the angle θ2 of the discharge port 23 has been described, the angle θ2 of the discharge port 23 may be set to be greater so long as the pressurizing timing does not coincide with the depressurizing timing.

Furthermore, in the above-mentioned embodiment, although the angle range of the suction port 22 is defined by taking 180° as the reference, the angle range may be defined with the reference angle smaller than 180° so long as the sucking property is not deteriorated.

Furthermore, in the above-mentioned embodiment, although the angle of the second transition section 25 is set so as to be equal to or smaller than the angle of the first transition section 24, the angle of the second transition section 25 may be set so as to become greater than the angle of the first transition section 24.

Furthermore, in the above-mentioned embodiment, although the angle θ1 of the suction port 22 is set such that the pressurizing timing is offset from the depressurizing timing all the time regardless of the amount of eccentricity of the cam ring 5, the angle θ1 may be set such that the pressurizing timing is offset from the depressurizing timing only for a predetermined amount of eccentricity.

Furthermore, in the above-mentioned embodiment, although the amount of eccentricity of the cam ring 5 is controlled by the control valve 10 by supplying the working fluid discharged from the discharge port 23 to the first fluid pressure chamber 11 and the second fluid pressure chamber 12 provided on the outer circumference of the cam ring 5, the present invention can also be applied to a case in which the amount of eccentricity of the cam ring 5 is controlled by other methods than those utilizing the pressure of the working fluid.

This application claims priority based on Japanese Patent Application No. 2013-33782 filed with the Japan Patent Office on Feb. 22, 2013, the entire contents of which are incorporated into this specification.

The invention claimed is:

1. A variable displacement vane pump used as a fluid pressure source, comprising:

a rotor that is configured to be rotationally driven by motive power from a motive-power source;

a plurality of slits radially formed so as to open to an outer circumference of the rotor;

vanes slidably received in the respective slits;

a cam ring having an inner circumferential cam face with which tip portions of the vanes are brought into sliding contact, the cam ring being configured to be eccentric to a center of the rotor;

a side member provided in contact with a side surface of the cam ring;

pump chambers defined by the rotor, the cam ring, the side member, and the adjacent vanes;

a suction port formed to have an arc shape on the side member in a region in which displacement of the pump chambers are expanded by rotation of the rotor, the suction port being configured to guide working fluid to be sucked into the pump chambers; and a discharge port formed to have an arc shape on the side member in a region in which displacement of the pump chambers are contracted by rotation of the rotor, the discharge port being configured to guide working fluid discharged from the pump chambers, wherein the side member has a first transition section and a second transition section, the first transition section being a section from an end point of the suction port to a start point of the discharge port, the second transition section being a section from an end point of the discharge port to a start point of the suction port, an angle between the start point and the end point of the suction port with respect to the rotor serving as a center is set such that a pressurizing timing is offset from a depressurizing timing, the pressurizing timing being a timing at which one of the pump chambers starts to communicate with the start point of the discharge port from the first transition section, the depressurizing timing being a timing at which another of the pump chambers starts to communicates with the start point of the suction port from the second transition section, and when a number n of the vanes is an odd number of five or more, an angle θ between the start point and the end point of the suction port with respect to the rotor serving as the center satisfies $1800-(3600/(2\times n))-t\leq\theta\leq1800+(3600/(2\times n))+t$, with an angle corresponding to thicknesses of the vanes being indicated as t.

2. The variable displacement vane pump according to claim 1, wherein the angle between the start point and the end point of the suction port with respect to the rotor serving as the center is greater than an angle between the start point and the end point of the discharge port with respect to the rotor serving as the center.

3. The variable displacement vane pump according to claim 1, wherein an angle of the second transition section with respect to the rotor serving as a center is smaller than an angle of the first transition section with respect to the rotor serving as a center.

4. The variable displacement vane pump according to claim 1, wherein the angle between the start point and the end point of the suction port with respect to the rotor serving as a center is set such that the pressurizing timing is offset from the depressurizing timing all the time regardless of an amount of eccentricity of the cam ring.

5. The variable displacement vane pump according to claim 1, further comprising:

a first fluid pressure chamber and a second fluid pressure chamber defined in an accommodating space on an outer circumference of the cam ring, the first fluid pressure chamber and the second fluid pressure chamber being configured to make the cam ring eccentric to the rotor by a pressure difference between the first fluid pressure chamber and the second fluid pressure chamber; and a control valve that is configured to operate in response to a pressure of working fluid guided from the discharge port, to control pressure of the working fluid in the first fluid pressure chamber and the second fluid pressure chamber to change the amount of eccentricity of the cam ring to the rotor, and to control a discharge flow amount of the pump.

6. A variable displacement vane pump used as a fluid pressure source, comprising:

a rotor that is configured to be rotationally driven by motive power from a motive-power source;

a plurality of slits radially formed so as to open to an outer circumference of the rotor;

vanes slidably received in the respective slits;

a cam ring having an inner circumferential cam face with which tip portions of the vanes are brought into sliding contact, the cam ring being configured to be eccentric a center of the rotor;

a side member provided in contact with a side surface of the cam ring;

pump chambers defined by the rotor, the cam ring, the side member, and the adjacent vanes;

a suction port formed to have an arc shape on the side member in a region in which displacement of the pump chambers are expanded by rotation of the rotor, the suction port being configured to guide working fluid to be sucked into the pump chambers; and a discharge port formed to have an arc shape on the side member in a region in which displacement of the pump chambers are contracted by rotation of the rotor, the discharge port being configured to guide working fluid discharged from the pump chambers, wherein the side member has a first transition section and a second transition section, the first transition section being a section from an end point of the suction port to a start point of the discharge port, the second transition section being a section from an end point of the discharge port to a start point of the suction port, an angle between the start point and the end point of the suction port with respect to the rotor serving as a center is set such that a pressurizing timing is offset from a depressurizing timing, the pressurizing timing being a timing at which one pump chamber starts to communicate with the start point of the discharge port from the first transition section, the depressurizing timing being a timing at which another pump chamber starts to communicates with the start point of the suction port from the second transition section, and when a number n of the vanes is an even number of six or more, an angle θ between the start point and the end point of the suction port with respect to the rotor serving as the center satisfies $180°-t\leq0\leq180°+(360°/n)+t$, with an angle corresponding to a thicknesses of the vanes being indicated as t.

7. The variable displacement vane pump according to claim 6, wherein an angle of the second transition section with respect to the rotor serving as a center is smaller than an angle of the first transition section with respect to the rotor serving as a center.

8. The variable displacement vane pump according to claim 6, wherein the angle between the start point and the end point of the suction port with respect to the rotor serving as a center is set such that the pressurizing timing is offset from the depressurizing timing all the time regardless of an amount of the eccentricity of the cam ring.

9. The variable displacement vane pump according to claim 6, further comprising:

a first fluid pressure chamber and a second fluid pressure chamber defined in an accommodating space on an outer circumference of the cam ring, the first fluid pressure chamber and the second fluid pressure chamber being configured to make the cam ring eccentric to the rotor by a pressure difference between the first fluid pressure chamber and the second fluid pressure chamber; and a control valve that is configured to operate in response to a pressure of working fluid guided from the discharge port, to control pressure of the working fluid in the first fluid pressure chamber and the second fluid pressure chamber to change the amount of the eccentricity of the cam ring to the rotor, and to control a discharge flow amount of the pump.

10. The variable displacement vane pump according to claim 6, wherein the angle between the start point and the end point of the suction port with respect to the rotor serving as the center is greater than an angle between the start point and the end point of the discharge port with respect to the rotor serving as the center.

* * * * *